United States Patent [19]

Staheli

[11] Patent Number: 4,897,897

[45] Date of Patent: Feb. 6, 1990

[54] CLOTHING FOR A CLEANING OR OPENING ROLLER

[75] Inventor: Paul Staheli, Wilen B. Wil, Switzerland

[73] Assignee: Rieter Machine Works, Ltd., Winterthur, Switzerland

[21] Appl. No.: 325,655

[22] Filed: Mar. 20, 1989

[30] Foreign Application Priority Data

Apr. 7, 1988 [DE] Fed. Rep. of Germany ..... 3811682

[51] Int. Cl.[4] ..... D01G 15/84

[52] U.S. Cl. ..... 19/114; 241/294

[58] Field of Search ..... 19/80 R, 85, 94, 97, 19/112, 114, 115 A, 115 R; 241/294

[56] References Cited

U.S. PATENT DOCUMENTS

| | | | |
|---|---|---|---|
| 2,588,900 | 3/1952 | Warsmith | 241/294 |
| 4,627,131 | 12/1986 | Iwafa | 19/114 |
| 4,801,101 | 1/1989 | Dreyer et al. | 241/294 |

FOREIGN PATENT DOCUMENTS

| | | | |
|---|---|---|---|
| 8124640 | 12/1981 | Fed. Rep. of Germany | 293/120 |
| 3030278 | 2/1982 | Fed. Rep. of Germany | 19/112 |
| 3504615 | 6/1986 | Fed. Rep. of Germany | 19/85 |
| 59-82425 | 5/1984 | Japan | 19/114 |
| 62103 | 5/1913 | Switzerland | 19/112 |
| 1148912 | 4/1985 | U.S.S.R. | 19/114 |
| 1234460 | 5/1986 | U.S.S.R. | 19/114 |

*Primary Examiner*—Werner H. Schroeder
*Assistant Examiner*—D. Price
*Attorney, Agent, or Firm*—Kenyon & Kenyon

[57] ABSTRACT

A toothed strip or forming a clothing on a roller is formed of a plurality of teeth disposed along a front face of the face in alternating relation with a plurality of troughs. Each tooth has an equilateral triangle shaped front face with a flat apex and an equilateral triangle shaped back which extends from the apex of the front face of the tooth. Each trough is inclined upwardly from the front face of the strip towards the rear and merges into the backs of adjacent teeth. During operation, fibers are able to fold about the teeth without the free ends of the fibers coming together and coiling.

20 Claims, 1 Drawing Sheet

1/1

CLOTHING FOR A CLEANING OR OPENING ROLLER

This relates to a clothing for a cleaning or opening roller. More particularly, this invention relates to a toothed strip for forming a clothing on a roller for use in fiber preparation in yarn manufacture.

Heretofore, various types of cleaning or opening rollers have been known for the preparation of fiber in yarn manufacture. In some cases, the cleaning or opening rollers cooperate with a grate which extends over part of the periphery of the roller in order to prepare the fiber. German Gbm No. 81 24 640.4 illustrates an arrangement in which the waste fibers from yarn manufacture in a vertical chute are fed to a cleaning roller by means of two oppositely rotating delivery rollers disposed at the bottom end of the chute. As described, the cleaning roller rotates at a peripheral speed of about 14 meters per second and is provided with a number of strips equipped with radial round pins on the periphery so as to function as a beater roller. The roller is also closely surrounded by a housing which is partially formed by the grate such that the surface of the grate occupies about 40% of the peripheral surface, i.e. the grate extends over an angle of about 140°. During operation, the waste material is guided over the grate a number of times by the beater roller and foreign bodies contained in the fiber material are separated through the grate by centrifugal force. After repeated revolutions, the fiber material, pre-cleaned by the beater roller, is conveyed through a feed chute to a following additional cleaning machine.

Other types of cleaning and opening rollers are described in Russian Patent Applications SU No. 1234-460-A and SU No. 1148-912-A; German DE No. 30 30 278 and Swiss No. 62103.

Historically considered, a clothing in the form of bars has been previously used on opening rollers. Although such bars gave a good beating action and, hence, a good opening effect, the bars did not have any combing action. In addition, the beating effect was excessive in some cases. Subsequently, the rollers were equipped with needles or round bars of a diameter of from 2 to 3 millimeters. While a combing effect was thus achieved, the cleaning effect declined and fibers stuck to the needles and formed coils.

Opening rollers have also been known which carry toothed discs which are of spiral construction while the teeth of the discs are disposed helically on a cylindrical roller such as described in German Patent No. 3504615.

Accordingly, it is an object of the invention to provide a clothing for a cleaning or opening roller which provides an adequate cleaning effect as well as a combing effect without causing coiling of fibers thereon.

It is another object of the invention to avoid coiling of fibers on a clothing of a roller during a cleaning or opening operation.

It is another object of the invention to provide a relatively simple tooth construction for a clothing of a cleaning or opening roller.

Briefly, the invention provides a toothed strip for forming a clothing on a roller which includes a plurality of teeth disposed along a front face of the strip in alternating relation with a plurality of troughs. In accordance with the invention, each tooth has an equilateral triangular shaped front face and an equilateral triangular shaped back having an apex at the front face of the strip. In addition, each trough is inclined upwardly from the front face of the strip towards the rear.

By securing a plurality of such tooth strips to a cylindrical roller, a suitable cleaning or opening roller is provided for fiber preparation in yarn manufacture.

During operation, fibers fold in the form of a U around the teeth with the free ends being kept apart due to the increasing width of the backs of the teeth and the particular air flow between the teeth and around the edges of the backs of the teeth. In this respect, it has been found that the reason for undesirable coiling of the fibers in previously known constructions is that the downstream free ends of the fibers which fold about the previously used pins or teeth come close together as a result of the air flow produced by the rotation of the roller and become coiled around one another.

Surprisingly, it has been found that the improved separation of dirt particles can be achieved if the teeth of the toothed strips are not rounded but have edges which are not sharp enough to cut the fibers. Apparently, these edges are able to strip the dirt particles destroyed by the beating effect from the fibers with good efficiency. This is particularly important because the manufacturing costs for the toothed strips can be appreciably lowered in this way since all that is required is to de-burr, but not round off, the edges. In this respect, the edges of the teeth are not knife edges but rather are characterized herein as "blunt edges".

These and other objects and advantages of the invention will become more apparent from the following detailed description taken in conjunction with the accompanying drawings wherein:

FIG. 1*a* illustrates a cross sectional view of a tooth strip in accordance with the invention taken on line I—I of FIG. 4;

FIG. 1*b* illustrates a cross sectional view of a modified strip having a forwardly sloped front face in accordance with the invention;

FIG. 1*c* illustrates a cross sectional view of a further modified strip having a rearwardly inclined front face in accordance with the invention;

Figure 2:
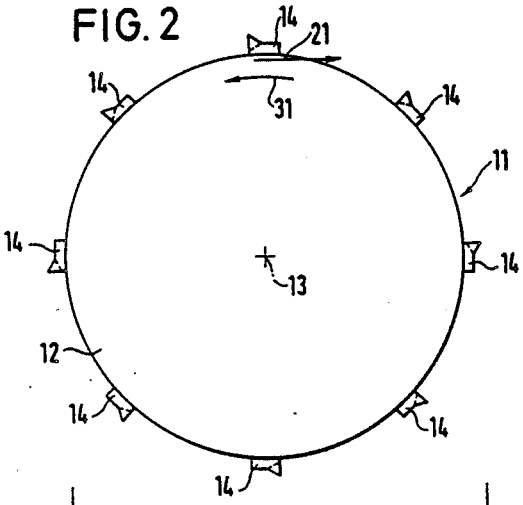
FIG. 2 illustrates an end elevational view of a cleaning roller provided with eight tooth strips in accordance with the invention.

Referring to FIG. 2, the cleaning or opening roller 11 is constructed of a drum 12 which is rotatable about a longitudinal axis of rotation 13 in a counter-clockwise during as indicated by arrows 31 as well as a plurality, eight, of toothed strips 14 which are secured by screws (not shown) to the peripheral surface of the drum 12 at regular intervals. As indicated, each strip 14 extends longitudinally of the drum 12 in parallel relation to the axis of rotation 13.

Figure 1A:
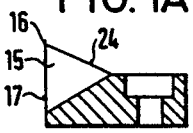
Figure 1B:
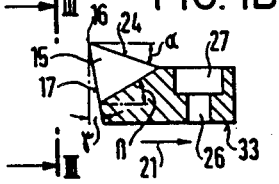
Figure 3:
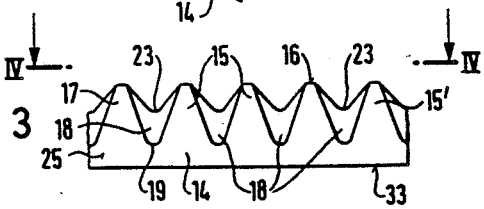
FIG. 3 illustrates a view taken on line III—III of FIG. 1*b*.
Figure 4:
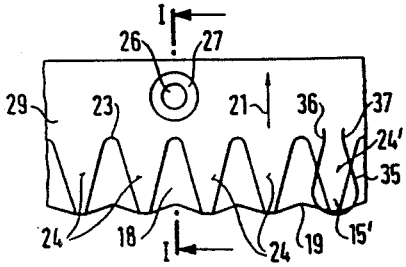
FIG. 4 illustrates a view taken on line VI—VI of FIG. 3.

Referring to FIGS. 1*b*, 3 and 4, each toothed strip 14 has a plurality of teeth 15 disposed along a front face of the strip 14 in alternating relation with a plurality of troughs 18.

Referring to FIG. 3, each tooth 15 has an equilateral triangular shaped front face 17 with a flat apex 16. In addition, as illustrated in FIG. 4, each tooth 15 has a back 24 which is of equilateral triangular shape and which has an apex at the front face of the strip 14, that is, at the apex 16 of the front face of the tooth 15.

Referring to FIGS. 1*b* and 3, each trough 18 is inclined upwardly from the front face of the strip 14 towards a rear of the strip, that is, in the direction indicated by the arrow 21 in FIG. 1*b*. Thus, the front end 19 of each trough 18 is disposed closer to the base 33 of the strip 14, and thus, the peripheral surface of the drum 12, than the rear end 23 of the trough 18. As indicated in FIG. 3, each rearwardly sloping trough 18 leads to the backs 24 of two adjacent teeth 15.

Referring to FIG. 1*b*, the front face 17 of each tooth 15 forms a continuation of the front face 25 of the strip 14 and is parallel or planar therewith.

Referring to FIGS. 1*b* and 4, each strip 14 has a rear strip-shaped zone 29 behind the teeth 15 in which a plurality of stepped bores 26 are provided for the passage of screws in order to secure the strip 14 to the drum 12. As indicated, each bore 26 is stepped so that the head of a countersunk screw may come to rest in a wider part 27 of the bore 26 to avoid catching fibers and to avoid interfering with the air flow around the opening roller 12. During operation, the outer ends of the countersunk heads of the screws (not shown) are flush with the surface 28 of the strip-shaped zone 29.

As indicated in FIG. 1*b*, the back 24 of each tooth 15 slopes down rearwardly from the flat apex 16 of a tube 15. For example, each back 24 slopes down on an angle $\alpha$ to a horizontal plane, that is, a plane parallel to the base 33 of the strip, of from 10° to 20°, for example 15°. In addition, each trough 18 slopes upwardly to the horizontal plane on an angle $\beta$ of from 25° to 47°, for example 36°. Each trough 18 also has a semi-circular base of a radius of from 1 to 4 millimeters, for example 1.5 millimeters, with the lowest point 19 at a distance from the base 33 of the strip in the range of about 3 millimeters.

The teeth 15 of a strip 14 are spaced apart a distance of from 11 to 18 millimeters, for example, 14.5 millimeters and the total height of a tooth from the root, that is, the base 33, to the apex 18 is from 9 to 15 millimeters. In addition, the flattened apex 16 of each tooth 15 is of a width of 2 millimeters.

Figure 1C:
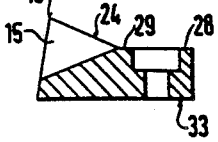

As indicated in FIG. 1*b*, the front face 17 of each tooth 15 is inclined to the base 33 of the strip, for example on an angle of inclination of from −10° to +10°. For example, in the embodiment shown in FIG. 1*b*, the angle is +5°, that is, the faces 17 are inclined forwardly. In the embodiment of FIG. 1*c*, the angle is −5°, that is, the faces 17 are inclined rearwardly. In the embodiment of FIG. 1*a*, the angle is 0°, that is, the front face 17 of each tooth 15 is perpendicular to the base of the strip 14 and is in a radial plane passing through the axis of rotation 13 of the drum 12.

The edges where the teeth 15 and troughs 18 merge together are not formed as knife edges or as edges which are sharp enough to cut a fiber. Instead, the edges are blunt without being rounded by a machining operation, i.e. the edges may be simply de-burred during manufacture to smooth out the edges.

Referring to FIG. 4, during operation, a fiber 35 will fold in the shape of a U around a respective tooth 15'. As indicated, the back 24' of the tooth 15 and the air flow provided by the configuration of the toothed strip 14 holds the two free ends 36, 37 of the fiber 35 apart so that coiling of the ends together cannot occur. During continued operation of the roller, the fiber 35 can detach from the tube 15'.

In practice, it has been found that a cleaning roller using a toothed strip in accordance with the embodiment shown in FIG. 1*a*, obtains an optimal cleaning effect with a combing effect that can be termed "good". In comparison, with a toothed strip in accordance with the embodiment FIG. 1*b*, a better combing action but a somewhat poorer cleaning action is obtained. With the embodiment illustrated in FIG. 1*c*, an inferior effect is obtained both in the combing action and the cleaning action, however, such effects are better than those obtained by previously known structures.

The invention thus provides a toothed strip for forming a clothing on a cleaning or opening roller which is able to provide both an effective cleaning effect and an electrical combing effect on fibers which are being prepared for yarn production.

What is claimed is:

1. A toothed strip for forming a clothing on a roller, said strip including a plurality of teeth disposed along a front face of the strip in alternating relation with a plurality of troughs, each said tooth having an equilateral triangular shaped front face and an equilateral triangular shaped back, each said back having an apex at said front face of the strip; and each said trough being inclined upwardly from said front face of the strip towards a rear thereof.

2. A toothed strip as set forth in claim 1 wherein each tooth has a flat apex at said front face of a width of about 2 millimeters.

3. A toothed strip as set forth in claim 2 wherein each tooth back slopes down rearwardly from said flat apex of said tooth.

4. A toothed strip as set forth in claim 3 wherein each tooth back slopes down on an angle to a horizontal plane of from 10° to 20°.

5. A toothed strip as set forth in claim 4 wherein each trough slopes upwardly to said horizontal plane on an angle of from 25° to 47°.

6. A toothed strip as set forth in claim 1 wherein said teeth are spaced apart a distance of from 11 to 18 millimeters.

7. A toothed strip as set forth in claim 1 wherein each tooth is of a height from a root thereof to said apex thereof of from 9 to 15 millimeters.

8. A toothed strip as set forth in claim 1 wherein each trough has a semi-circular base of a radius of from 1 to 4 millimeters.

9. A toothed strip as set forth in claim 1 wherein said front face of each tooth is perpendicular to a base of the strip.

10. A toothed strip as set forth in claim 1 wherein said front face of each tooth is inclined to a base of the strip.

11. A toothed strip as set forth in claim 10 wherein said front face of each tooth is inclined to a perpendicular plane to said base on an angle of −10° to +10°.

12. A toothed strip as set forth in claim 1 wherein the strip has a plurality of openings in a strip-shaped zone behind said teeth for passage of screws therethrough.

13. A toothed strip as set forth in claim 1 wherein each trough has a lowest point at a distance in the range of about 3 millimeters from a base of the strip.

14. A toothed strip as set forth in claim 1 wherein each tooth has blunt edges.

15. A toothed strip for a clothing of a roller comprising a plurality of teeth disposed along a front face of the strip, each said tooth having a front face of equilateral triangular shape with a flat apex at said front face of the strip and a flat back of equilateral triangular shape extending from said front face; and a plurality of troughs disposed in alternating relation with said teeth, each said trough being inclined upwardly from said front face of the strip towards a rear thereof.

16. A toothed strip as set forth in claim 15 wherein said front face of each tooth is inclined forwardly to a base of the strip.

17. A toothed strip as set forth in claim 15 wherein said block of each tooth slopes down rearwardly from said front face of the strip.

18. A toothed strip as set forth in claim 15 which further comprises a strip-shaped zone rearwardly of said teeth, said zone having at least one stepped bore for receiving a screw for securing the strip to a roller.

19. A toothed strip as set forth in claim 15 wherein said teeth are spaced apart a distance of from 11 to 18 millimeters, and each tooth has a height of from 9 to 15 millimeters.

20. A toothed strip as set forth in claim 19 wherein each trough has a semi-circular base of a radius of from 1 to 4 millimeters.

* * * * *

UNITED STATES PATENT AND TRADEMARK OFFICE

CERTIFICATE OF CORRECTION

PATENT NO. : 4,897,897

DATED : Feb. 6, 1990

INVENTOR(S) : PAUL STAHELI

It is certified that error appears in the above-identified patent and that said Letters Patent is hereby corrected as shown below:

Column 2, line 54 "During" should be -Direction-
Column 5, line 11 "block" should be -back-

Signed and Sealed this

Twenty-first Day of April, 1992

*Attest:*

HARRY F. MANBECK, JR.

*Attesting Officer*

*Commissioner of Patents and Trademarks*